United States Patent [19]

Churchman et al.

[11] 4,039,027

[45] Aug. 2, 1977

[54] CIRCUMFERENTIAL CENTRALIZER

[75] Inventors: Ronald K. Churchman, Plano; John H. Yonker, Dallas, both of Tex.

[73] Assignee: Otis Engineering Corporation, Dallas, Tex.

[21] Appl. No.: 654,520

[22] Filed: Feb. 2, 1976

[51] Int. Cl.[2] ..... E21B 41/00

[52] U.S. Cl. ..... 166/153; 166/241; 277/149

[58] Field of Search ..... 166/133, 136, 153, 192, 166/214, 241; 277/92, 149, 165, 216–223

[56] References Cited

U.S. PATENT DOCUMENTS

| | | | |
|---|---|---|---|
| 1,896,482 | 2/1933 | Crowell | 166/136 |
| 2,007,691 | 7/1935 | Phillips | 277/149 |
| 2,373,880 | 4/1945 | Driscoll | 166/241 |
| 2,411,667 | 11/1946 | Mowrey | 166/241 |
| 2,499,952 | 3/1950 | Harbison | 277/220 |
| 2,590,245 | 3/1952 | Harbison | 277/216 |
| 3,420,536 | 1/1969 | Grover | 277/165 |
| 3,692,108 | 9/1972 | Soulie et al. | 166/153 |
| 3,814,445 | 6/1974 | Bitzan | 277/165 |

*Primary Examiner*—James A. Leppink
*Attorney, Agent, or Firm*—Vinson & Elkins

[57] ABSTRACT

Disclosed is a pumpdown tool for a well, the tool including a housing having a circumferentially extending seal on its outer surface and having a circumferential centralizer to protect the seal while the tool is being run in the well tubing.

7 Claims, 5 Drawing Figures

CIRCUMFERENTIAL CENTRALIZER

This abstract is neither intended to define the scope of the invention which, of course, is measured by the claims, nor is it intended to be limiting in any way.

BACKGROUND OF THE INVENTION

1. Field of the Invention

This invention relates to a pumpdown tool for a well, the tool having a circumferential seal and a circumferential centralizer to protect the seal.

2. The Prior Art

With the increased number of offshore wells, more pumpdown tools are being used.

Often the well extends into the earth from the ocean floor at a point remote from the production facilities. Pumpdown tools may be pumped to the well from the production facilities through a flowline lying on the ocean floor. Alternatively, instead of having the flowline on the ocean floor, the well tubing may be highly deviated and the pumpdown tools are pumped through this highly deviated portion of the tubing before entering a relatively vertical portion of the tubing.

Some pumpdown tools have a circumferential seal which, when the tool is landed in a nipple in the well tubing, is adapted to seal with the inner wall of the nipple. While the pumpdown is being run through the substantially horizontal flowline on the ocean floor or through a highly deviated portion of the tubing, these resilient seals are nicked, worn, and otherwise damaged. When the tool is landed in the nipple, the seal may be ineffective because of this damage.

Bow springs have been used to centralize tool in a well and to kickover valves into a side-pocket mandrel.

OBJECTS OF THE INVENTION

It is an object of this invention to provide a pumpdown tool for a well having a protector for the circumferential seal of the tool.

It is another object of this invention to provide a pumpdown tool for a well wherein the tool's circumferential resilient seal is protected against damage as the tool is run in the well tubing by a centralizer which is effective for substantially the entire circumference of the tool.

Another object of this invention is to provide a centralizer that is short and can be used on a pumpdown tool.

Another object of this invention is to provide a centralizer for a pumpdown tool which bridges a circumferential seal of the tool to protect the same while the tool is being run through the well tubing.

These and other objects and features of advantage of this mention will be apparent from the drawings, the detailed description, and the appended claims.

BRIEF DESCRIPTION OF THE DRAWINGS

In the drawings wherein like numerals indicate like parts and wherein an illustrative embodiment of this invention is shown.

DESCRIPTION OF THE PREFERRED EMBODIMENT

Figure 1:
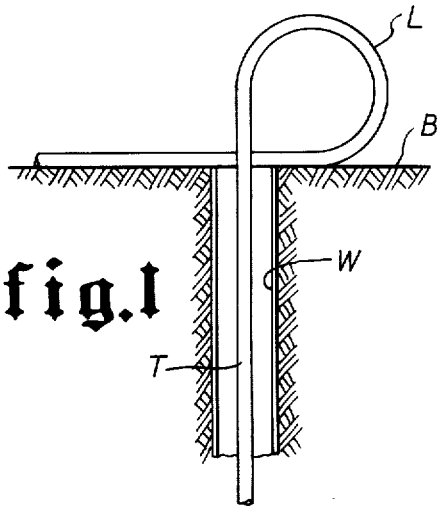
FIG. 1 is a schematic sectional view illustrating the use of a loop in a production string through which a pumpable tool train may be introduced into a well.

In FIG. 1, a typical oil or gas well W at the bottom B of a body of water is illustrated. The production tubing T extends from a suitable production platform (not shown) along the bottom B, forms a loop L, and extends through the well W. The loop L is suitably supported and has a preselected radius of curvature which permits pumpdown tool trains and other equipment to be pumped therethrough into the production string within the well. The loop L and the well W may be located a substantial distance from the production platform (not shown).

Figure 2:
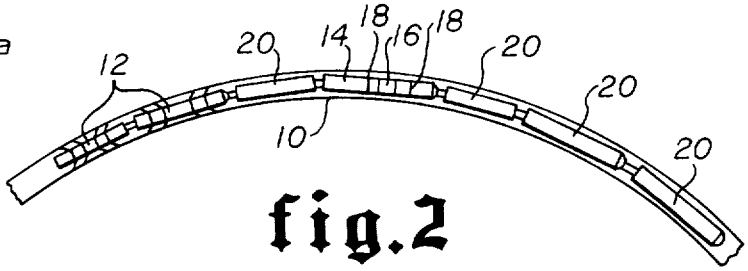
FIG. 2 is a sectional view of a portion of a bend in the production tubing illustrating a pumpdown tool train being pumped through the bend.
Figure 4:
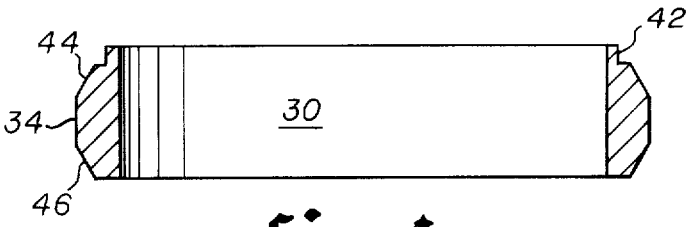
FIG. 4 is a cross-sectional view of a ring which may be used as a portion of the centralizer in accordance with this invention.

Because of the curvature through which the tool train must pass before entering the W, the tool train is formed into short sections with each section joined to the others by an articulating joint as shown in FIG. 2.

if the pumpdown tool has a circumferential seal, it will be engaged by the inner wall of the horizontal tubing. This engagement may nick, scratch, wear and otherwise damage the circumferential seal so that when the tool is landed in a nipple in the well tubing the seal may be ineffective.

In accordance with this invention the pumpdown tool includes a centralizer to protect the circumferential seal. There are certain desirable features for such a centralizer. The centralizer should be short so that it is usable with the short sections of a pumpdown tool train. The centralizer should be able to be positioned so that it can protect a seal in any tool of the pumpdown tool train. The centralizer should be effective to protect the seal for substantially the entire circumference of the tool so that the seal does not become damaged. The centralizer should not inhibit the running of the pumpdown tool train through the flowline on the bottom of a body of water, a highly deviated portion of the tubing, the loop or curvature, or through the vertical tubing, landing nipples or the like. When the pumpdown tool train is landed, the centralizer should not inhibit the effectiveness of the seal.

FIG. 2 schematically shows a pumpdown tool train having a pumpdown tool with the seal and centralizer of this invention. The pumpdown tool train is shown in a curvature 10. The train includes piston locomotives 12 and a pumpdown tool 14 having a circumferential seal 16. On either side of the seal 16 is positioned a circumferential centrilizer 18 to protect the seal 16. The tool train may also include other tools 20.

Figure 3:
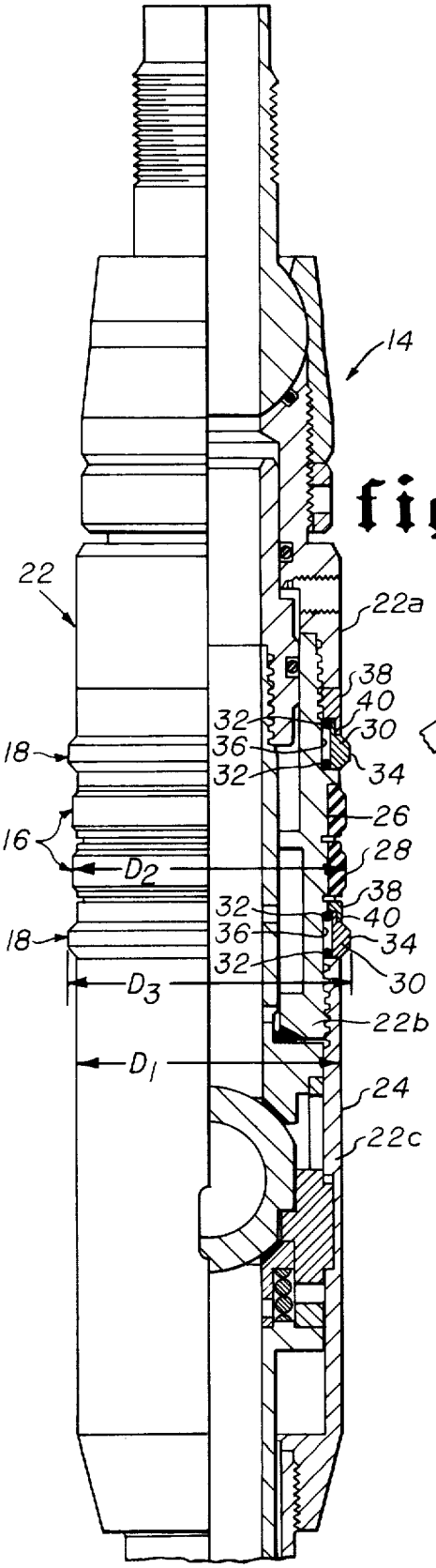
FIG. 3 is a quarter-sectional view of a pumpdown tool having a seal and centralizer in accordance with this invention.

In FIG. 3, an enlarged view of the tool 14, seal 16 and centralizer, generally indicated at 18, is shown.

Although the tool 14 illustrated in FIG. 3 is a conventional pumpdown subsurface tubing safety valve, it is to be understood that the tool 14 may be any desired pumpdown tool for a well.

The tool 14 includes an elongate outer housing generally indicated at 22, comprising sections **22*a*, 22*b*, and 22*c*. Housing means 22 has an exterior surface 24** of a first diameter $D_1$.

Extending circumferentially around the housing means 22 is seal means 16. To maintain seal means 16 around the exterior of housing means 22, seal means 16 is preferably located within an annular recess 26 of housing means 22. Seal means 16 has an outer surface 28 of a second diameter $D_2$ which is greater than the diameter $D_1$ of the outer surface 24 of housing means 22. The outer surface 28 of seal means 26 is adapted to seal with the inner wall of a landing nipple (not shown) when the pumpdown tool 14 is landed within a nipple of the tubing T.

To protect seal means 16 when the tool 14 is being pumped through the substantially horizontal flowline along the bottom B or through a highly deviated portion of the tubing T, the tool 14 includes circumferential centralizer means, indicated generally at 18. Preferably circumferential centralizer means 18 is located in close proximity to seal means 16 and bridges seal means 16 so that it is effective to prevent the outer surface 28 of the seal means 16 from engaging the inner wall of the tubing T until the tool 14 is landed in the landing nipple (not shown). While a single centralizer of greater diameter could cooperate with the housing 22 of the tool 14 on the other side of the seal means 16, a pair of lesser diameter centralizers bridging seal means 16 is preferred as the latter reduces the effective diameter of the tool 14 while being run.

Centralizer means 18 includes an expandable and contractible ring means 30 to engage the inner wall of the tubing T and backing means 32 to maintain ring means 30 substantially concentric with respect to housing means 22.

Ring means 30 surrounds housing means 22 and has an outer boss 34 of a diameter $D_3$ such that when ring means 30 is in expanded form the diameter of the boss $D_3$ is greater than the diameter $D_2$ of seal means 16. By carrying such a ring means 30 on housing means 22 in close proximity to and bridging seal means 16, seal means 16 is protected against damage as the tool 14 is run in a well tubing T.

Preferably, ring means 30 comprises a spring which is in expanded condition when unstressed so that it naturally tends to assume it expanded form.

To carry ring means 30 on housing means 22, housing means 22 has circumferentially extending annular groove means 36 in its outer surface 24. Ring means 30 is carried in groove means 36. Groove means 36 is located in close proximity to seal means 16 so that ring means 30 may be in close proximity to seal means 16. To provide centralizer means 18 capable of bridging seal means 16, a groove means 36 is located on each side of seal means 16 and ring means 30 is positioned within each groove means 36.

Preferably groove means 36 is of a depth sufficient to permit conraction of ring means 30 into groove means 36 so that ring means 30 is able to be received within the landing nipple (not shown).

To maintain ring means 30 substantially concentric with housing means 22 while the tool 14 is being run in a well tubing, resilient annular backing means 32 is provided in groove means 36 between ring means 30 and housing means 22. Backing means 32 maintains the ring means 30 substantially concentric with housing means 22 to enable ring means 30 to perform it centralizing function. Additionally, backing means 32 permits contraction of ring means 30 into groove means 36 until the diameter of the boss 34 is substantially the same as the diameter $D_1$ of housing means 22. Preferably, backing means 32 is provided by at least one O-ring in groove means 36 in engagement with both the groove means 36 and ring means 30 when ring means 30 is in its expanded form.

Retainer means 38 may be carried by housing means 22 to retain at least a portion of ring means 30 within groove means 36. To retain ring means 30 within groove means 36, retainer means 38 has a lip 40 which extends over groove means 36 and engages a complimentary lip 42 of ring means 30. While ring means 30 is in its expanded form on housing means 22, the lip 40 of retainer means 38 engages the lip 42 of ring means 30 and maintains ring means 30 substantially concentric with respect to housing means 22.

To permit ring means 30 to by-pass obstructions as the tool 14 is run in a well tubing by being contracted within groove means 36, rings means 30 has an upper and a lower chamfered surface 44 and 46 which cams ring means 30 inward into groove means 36. The engagement of an obstruction by either chamfered surface contracts ring means 30 into groove means 36 while still maintaining the tool 14 centralized in the tubing.

Figure 5:
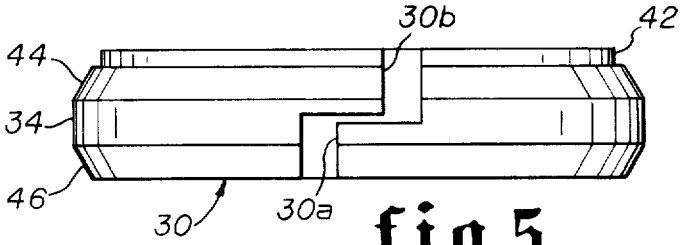
FIG. 5 is a view in elevation of the ring of FIG. 4.

To protect the complete circumference of seal means 16 from damage the boss 34 of ring means 32 should extend substantially around the circumference of the tool 14. Preferably therefore, ring means 32 is constructed with overlapping ends **30*a* and 30*b* with the boss 34 extending around ring means 30 to each of these ends 30*a* and 30*b*. (See FIG. 5). In this manner, the boss 34 extends around the circumference of the tool 14 and the complete circumference of seal means 16 is protected from damage by centralizer means 18**.

In operation, the pump down tool 14 of this invention including a circumferential seal 16 and circumferential centralizer means 18 is utilized when it is desired to protect the circumferential seal 16 from damage as the tool 14 is being run in a well tubing. The centralizer means 18, including ring means 30 and backing means 32 is positioned on housing means 22 close to seal means 16. Ring means 30 and backing means 32 may be maintained on housing means 22 by retainer means 40 in a groove means 36. At least one such circumferential centralizer means 18 is used, although preferably two centralizers are used with one on either side of seal means 16 so that seal means 16 is bridged by circumferential centralizer means 18.

As the tool 14 is being run through the substantially horizontal flow line or through a highly deviated portion of the tubing, circumferential centralizer means 18 protects circumferential seal means 16 from damage. Backing means 32 maintains ring means 30 substantially concentric with respect to the housing 22. Since the outside diameter $D_3$ of the boss 34 of ring means 30 is greater than the outside diameter $D_2$ of the outer surface 28 of seal means 16, the boss 34 slides along the inside wall of the tubing T thereby preventing the outer surface 28 of seal means 16 from engaging the inside wall of the tubing and being damaged. When an obstruction or restriction in the tubing is encountered, the chamfered surface contracts ring means 30 into groove means 36 thereby permitting the tool 14 to bypass the obstruction without hanging up. To prevent ring means 30 from hanging up on such an obstruction when ring means 30 is in its expanded form, the chamfered surface extends from the boss 30 to the outer surface 24 of housing means 22.

Even while ring means 30 is being partially collapsed within groove means 36 by an obstruction, ring means 30 is still centralizing the tool 14 and protecting seal means 16.

From the foregoing it can be seen that the objects of this invention has been obtained. A pumpdown tool has been provided with a circumferential seal and a short circumferential centralizer capable of protecting the entire circumference of the seal from damage as the tool is being run in the tubing.

The foregoing disclosure and description of the invention are illustrative and explanatory thereof and various changes in the size, shape and materials, as well as in the details of illustrated construction may be made within the scope of the appended claims without departing from the spirit of the invention.

What is claimed is:

1. A pumpdown tool for wells comprising:

elongate housing means adapted to be run in a well tubing and having an outer surface of a first diameter;

circumferentially extending seal means around said housing means adapted to effect a seal in the well after the tool has been run into the well and landed therein, said seal means having an outer surface of a second diameter which is greater than said first diameter;

said housing means having at least one circumferentially extending annular groove means in its outer surface in close proximity to said seal means;

expandable and contractible ring means surrounding said housing means and carried in said groove means, said ring means assuming its expanding form when unstressed, being normally carried around said housing means in expanded form, and having an outer boss, which boss, when said ring means is in expanded form, is of a diameter greater than said second diameter for protecting said seal means against damage as the tool is run in a well tubing;

said groove means being of a depth sufficient to permit contraction of said ring means into said groove means; and resilient backing means in said groove means between said ring means and said housing maintaining said ring means substantially concentric with respect to said housing means as the tool is run in a well tubing during contraction of said ring means and permitting contraction of said ring means until its outer surface is substantially the diameter of said housing.

2. The tool of claim 1 including:

retainer means carried by said housing means retaining at least a portion of said ring means within said groove means.

3. The tool of claim 1 wherein said resilient backing means comprises at least one O-ring.

4. The tool of claim 1 wherein:

said housing has two of said groove means with one groove means on either side seal means;

ring means is carried in each groove means; and backing means is in each of said groove means;

whereby said seal means is bridged by said ring means to protect said seal means against damage as the tool is run in a well tubing.

5. The tool of claim 1 wherein said ring means includes an outer circumferentially extending boss having an outer surface adapted to engage the wall of the tubing in which the tool is run and upper and lower chamfered surfaces extending from the boss to retract said ring means into said groove means when said boss encounters obstructions in the well.

6. The tool of claim 1 wherein said ring means includes two overlapping ends providing an effective outer boss for the entire circumference of said tool.

7. The tool of claim 5 wherein when said ring means is in expanded form, the chamfered surfaces extend from said boss at least to the outer surface of said housing means.

* * * * *